US005820539A

United States Patent [19]

Strahm

[11] Patent Number: 5,820,539

[45] Date of Patent: Oct. 13, 1998

[54] DEVICE AND METHOD FOR CONTINUOUS PLAITING OF WEB-SHAPED MATERIAL

[75] Inventor: Christian Strahm, Bronschhofen, Switzerland

[73] Assignee: Solipat AG, Zug, Switzerland

[21] Appl. No.: 730,324

[22] Filed: Oct. 9, 1996

[30] Foreign Application Priority Data

Oct. 12, 1995 [CH] Switzerland ..... 02889/95

[51] Int. Cl.[6] ..... B65H 45/107; B65H 31/32; B65H 1/14

[52] U.S. Cl. ..... 493/412; 493/357; 493/362; 493/413; 270/39.02; 270/39.05; 414/789.5; 414/793.8

[58] Field of Search ..... 493/411, 412, 493/413, 414, 357, 358, 405, 408, 409, 410, 417, 477, 478, 416; 270/39.01, 40, 39.02, 39.05, 52.03; 414/788.1, 789.5, 790.9, 791, 791.9, 793.8, 796.1

[56] References Cited

U.S. PATENT DOCUMENTS

| | | | |
|---|---|---|---|
| 4,162,649 | 7/1979 | Thornton . | |
| 4,359,218 | 11/1982 | Karls | 271/188 |
| 4,406,650 | 9/1983 | Felix | 493/412 |
| 4,673,382 | 6/1987 | Buck | 493/359 |
| 4,778,165 | 10/1988 | Buck | 270/39 |
| 4,820,250 | 4/1989 | Bunch | 493/414 |
| 4,842,573 | 6/1989 | Peter | 493/412 |
| 4,908,010 | 3/1990 | Yoshioka . | |
| 4,955,854 | 9/1990 | Roth | 493/357 |
| 5,085,624 | 2/1992 | Felix | 493/413 |
| 5,087,023 | 2/1992 | Gilbert | 270/39 |
| 5,123,890 | 6/1992 | Green | 493/357 |
| 5,145,159 | 9/1992 | Vits | 270/52 |
| 5,279,536 | 1/1994 | Abreu | 493/23 |
| 5,348,527 | 9/1994 | Beckwith | 493/413 |
| 5,558,318 | 9/1996 | Crowley | 270/39.05 |

FOREIGN PATENT DOCUMENTS

| | | |
|---|---|---|
| 116 100 | 8/1984 | European Pat. Off. . |
| 366 980 | 5/1990 | European Pat. Off. . |
| 453 983 | 4/1991 | European Pat. Off. . |
| 33 04 673 | 8/1984 | Germany . |

*Primary Examiner*—Stephen F. Gerrity
*Assistant Examiner*—Christopher W. Day
*Attorney, Agent, or Firm*—Shoemaker and Mattare, Ltd.

[57] ABSTRACT

A device (1) for continuous plaiting of web-shaped material with a plaiting table (2) and a plaiting arm (3) possesses auxiliary depositing means (5) insertable between the plaiting arm (3) and the plaiting table (2). The auxiliary depositing means (5) enable continuous plaiting of the material, even when the material stack (4) laid on the plaiting table (2) is being unloaded from the plaiting table (2). Apart from that, in order to attain the most regular possible layering of the web-shaped material, the plaiting table (2) and the auxiliary depositing means (5) are arranged to be height adjustable. Additionally, the auxiliary depositing means (5) possesses recesses (15) that can be penetrated by the supporting elements (16) of the plaiting table.

15 Claims, 13 Drawing Sheets

DEVICE AND METHOD FOR CONTINUOUS PLAITING OF WEB-SHAPED MATERIAL

Figure 1:
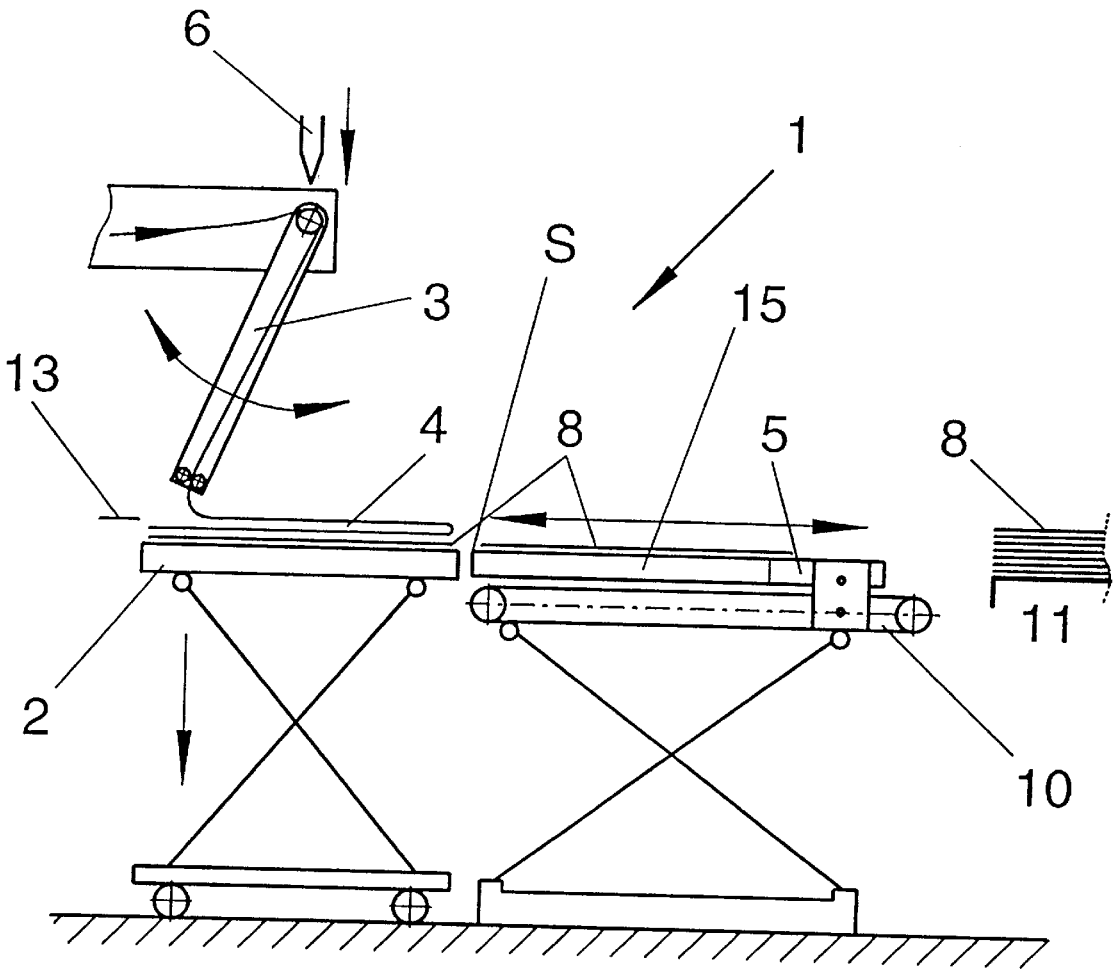

The present invention relates to a method and device for continuous plaiting of web-shaped material.

In the case of machines for processing or finishing web-shaped material, for example textile machines, after processing the material is frequently plaited. The term "plait" is understood to be the zigzag folding and laying down of web-shaped material onto trays, pallets or transport trolleys. In general, the material is lead past an arm moving to and fro like a pendulum, said arm laying the material down on a base in a zigzag shape.

As a base, a slidable or travelling plaiting table is generally used, for example in the form of a trolley. As soon as the layered stack of web-shaped material has attained a certain height, the base is removed, the stacked material is unloaded, and the empty plaiting table is returned to a position beneath the plaiting station. Arrangements of the prior art all have the drawback, however, that the machines operating in the line upstream of the plaiting station must be brought to rest during the unloading procedure. Because of the constant interruptions, productivity of the machines prior to the plaiting station will be greatly impaired. On the one hand, the machines will not be producing for a relatively long period, and on the other hand frequent stopping both complicates the construction and reduces the life span of the machines.

In U.S. Pat. No. 4,908,010, a device is disclosed for folding and cutting a continuous length of paper, wherein the subsequent paper sheet is folded onto the blade during the cutting operation, by which means the device can be continuously operated. In this case, and especially when used with textiles, there will be problems if the cutting blade rips out part of the material web on its return stroke. Transfer of the stack from the blade to the supporting table can prove to be complex with such devices.

Furthermore, EP 116 100 discloses a device for packaging of flat-shaped material. A material web is cut through by a blade, a temporary backing surface being slid beneath the material web by the blade at the same time, so that interruption of the working sequence is not required. Also with this device, there are problems when the deposited material is laid on the plaiting table from the temporary backing.

The purpose of the present invention is to avoid the disadvantages of the state of the art, and in particular to create a device for the continuous plaiting of web-shaped material, said device dispensing with the need for stopping the machines in the line upstream of the plaiting station and enabling regular plaiting.

A further purpose of the present invention is to create a method for the continuous plaiting of web-shaped material, said method dispensing with the need for stopping the machines in the line upstream of the plaiting station and enabling uniform plaiting.

According to the invention, this purpose is fulfilled with a device and with a method possessing the features of the independent patent claims.

The device according to the present invention for the plaiting of web-shaped material comprises a plaiting table and a plaiting arm arranged above said plaiting table, and additionally possesses additional auxiliary depositing means for continuous plaiting.

The auxiliary depositing means can be slid between the plaiting arm and the plaiting table in a direction of insertion and are provided with an insertion face. The term "insertion face" is understood to be that component of the auxiliary depositing means that is inserted first between the plaiting arm and the plaiting table.

The auxiliary depositing means are provided with at least one recess extending from said insertion face in the direction of insertion. Due to these recesses, the contact surface between the auxiliary depositing means and the stacked material can be reduced. In a particularly advantageous embodiment, the auxiliary depositing means comprise a rack. The recesses are in this case formed by the intermediate space between the individual rods of the rack. It is also conceivable, however, to employ flat auxiliary depositing means possessing only two or three recesses extending in the direction of insertion.

Such arrangements are particularly advantageous if, apart from that, the plaiting table is provided with upwardly pointing supporting elements formed to complement the recesses in the auxiliary depositing means so that said supporting elements can penetrate said recesses. Prior to transfer of the plaited material by the auxiliary depositing means to the plaiting table, said plaiting table can be raised (or the auxiliary depositing means can be lowered), so that the supporting elements penetrate the recesses in the auxiliary depositing means and support the plaited material. The auxiliary depositing means can then be simply pulled out between the stack of material and the plaiting table, since said auxiliary depositing means no longer make direct contact with the web of material. With that, the number and shape of the recesses is of little significance to the functioning of the device according to the present invention; essential is that the recesses extend from the insertion face of the auxiliary depositing means in the direction of insertion.

Apart from that, the supporting elements of a particularly advantageous plaiting table are arranged to be mobile. The supporting elements can, for example, be formed as circulating belts. In order to unload the plaiting table, said belts can be moved so that the stack of material can be brought from the plaiting table to an adjacent depositing position. In such cases, the supporting elements fulfil a function not only during transfer of the material from the auxiliary depositing means but also during transfer of the material for further working, such as packaging or transport.

The web-shaped material is led by the plaiting arm, said plaiting arm being able to move to and fro like a pendulum. By means of the pendulum motion of the plaiting arm, the web-shaped material is stacked in layers in a zigzag way on the plaiting table. Before the stack of web-shaped material is removed from the plaiting table, the auxiliary depositing means are inserted between the stack of material and the plaiting arm. The auxiliary depositing means assume the function of the plaiting table for a certain period. The plaiting table with the stack of material can therefore be removed from the plaiting station and unloaded without the need for interruption of the plaiting sequence. After emptying of the plaiting table, said table can be repositioned directly below the auxiliary depositing means and the new stack of material, deposited on said the auxiliary depositing means, can be transferred to the plaiting table.

In a preferred embodiment of the invention, the plaiting device also possesses a cutting device by which means the plaited material can be separated from the subsequent web prior to unloading of the plaiting table.

A particularly advantageous embodiment will result if the plaiting table and/or the auxiliary depositing means are arranged to be height-adjustable. As a result, the surface of the plaited stack of material can be maintained at the same height relative to the plaiting arm at all times. With advantage, both plaiting table and auxiliary depositing means are moved downwards during plaiting.

In a particularly preferred embodiment, the plaiting device possesses a feed device for covering the auxiliary depositing means with a flat underlay. The auxiliary depositing means, especially a rack, are covered with a flat underlay by the feed device. The underlay can preferably comprise cardboard. With said feed unit, cardboard can also be laid upon the upper side of the plaited stack of material. This preferably ensues shortly after the auxiliary depositing means has assumed the function of the plaiting table.

A particularly advantageous embodiment of the invention will result if the plaiting table is arranged to be slidable from a plaiting position into an unloading position.

The method according to the present invention for continuous plaiting of web-shaped material is characterized in that the plaiting table is replaced by the auxiliary depositing means during unloading. In a first step, the web-shaped material is laid in the usual way on a plaiting table. When the stack of layered material has reached the required height, the auxiliary depositing means assumes the function of the plaiting table. The plaiting table can be removed, along with the stacked material, from the plaiting station without interruption of the plaiting sequence, and thus without stopping the machines in the line upstream of the plaiting station. During unloading of the plaiting table, the material is plaited on the auxiliary depositing means. After unloading of the material, the plaiting table is once again returned into its original position and takes over the stack which was being stacked on the auxiliary depositing means. In this way, a continuous plaiting cycle will arise that dispenses with the need for stopping the machines upstream in the line.

The auxiliary depositing means possesses recesses extending from the insert face in the direction of insertion. Apart from that, the auxiliary depositing means possesses at least one supporting element extending upwards. For transfer of the stack of material laid upon the auxiliary depositing means, the plaiting table is raised and/or the auxiliary depositing means is lowered so that the supporting elements of the plaiting table penetrate the recesses of the auxiliary depositing means from below and raise the material laid upon the auxiliary depositing means. With that, the auxiliary depositing means is relieved of the plaited material and can simply be pulled out laterally between the supporting elements.

In a preferred method, the stacked material is separated from the subsequent web shortly before the plaiting table is replaced in its function by the auxiliary depositing means. A individual stack is thus always initially stacked on the auxiliary depositing means, and subsequently transferred to the plaiting table.

A particularly advantageous embodiment of the method will result if the plaiting table is lowered during plaiting so that the upper level of the stack of plaited material is maintained at a constant height. By means of such a method, because of the constant distance between the plaiting arm and the stack, a particularly regular layering of the web-shaped material will be attained. If the plaiting table is lowered during plaiting, it is advantageous to also lower the auxiliary depositing means during plaiting. Prior to assuming the function of the plaiting table, the auxiliary depositing means will be located slightly above the upper surface of the stack of material on the plaiting table. After assuming the function of the plaiting table, the auxiliary depositing means are likewise lowered in such a way that the upper level of the stack laid upon said auxiliary depositing means remains at a constant height. After emptying, the plaiting table is positioned in such a way that said table comes to lie within the auxiliary depositing means from beneath. Accordingly, transfer of the plaited stack from the auxiliary depositing means to the plaiting table will prove to be particularly simple.

Particularly simple unloading of the plaiting table will result if, in order to unload the stacked material, said plaiting table can be displaced from a plaiting position into an unloading position.

In a particularly simple method according to the present invention, the auxiliary depositing means are inserted between the plaiting arm and the upper level of the stack on the plaiting table, prior to unloading of the plaiting table.

In a preferred embodiment, the auxiliary depositing means are covered with a flat and stable underlay prior to assuming the function of a plaiting table. The web-shaped material is thus not plaited directly onto the auxiliary depositing means, but on an underlay lying upon said auxiliary depositing means. The stacked material remains lying on the firm underlay on the plaiting table, also during transfer onto the plaiting table and during the unloading sequence from said plaiting table. Use of this type of a firm underlay will achieve a constantly flat-lying lowermost layer of the stacked material, also when the auxiliary depositing means are withdrawn from beneath the stack. The firm underlay offers protection from folding, wrinkling or tearing, and also soiling by the auxiliary depositing means.

The invention is more exactly explained in the following, with the aid of embodiments and with the aid of the drawings: namely, FIG. 1 A schematic representation of a device according to the present invention at commencement of the plaiting sequence, FIG. 2 a schematic representation of a device according to the present invention during plaiting onto the auxiliary depositing means, FIG. 3 a schematic representation of the unloading sequence from the plaiting table, FIG. 4 a schematic representation of the device shortly before transfer of the material stack from the auxiliary depositing means to the plaiting table, FIG. 5 a schematic representation of the device according to the present invention during the normal plaiting sequence, FIGS. 6*a* to 6*c* plan views of various embodiments of auxiliary depositing means according to the present invention, FIG. 7 a schematic representation of the plaiting table and auxiliary depositing means of a particularly preferred embodiment, FIGS. 8*a* to 8*c* schematic representations of a plaiting table of a further embodiment, and FIG. 9 a frontal view of a device according to the present invention.

FIG. 1 shows a device 1 for plaiting of web-shaped material onto a plaiting table 2. The device 1 possesses a pendulum-like oscillating plaiting arm 3 for laying the web-shaped material in zigzag-shaped layers on the plaiting table 2. The material laid in a zigzag-shape forms a material stack 4. Apart from that, the device 1 possesses a cutting device 6 for separation of the material stack 4 from the subsequent web-shaped material, as well as auxiliary depositing means 5. The auxiliary depositing means 5 are mounted on a height-adjustable holder 10 so as to be able to slide horizontally. In addition, the auxiliary depositing means possess recesses 15 (only schematically suggested in FIGS. 1 to 5), said recesses extending from the insertion face S of the auxiliary depositing means 5 in the insertion direction R.

The plaiting table 2 is also arranged to be height-adjustable. The auxiliary depositing means 5 are able to be inserted between the upper level of the material stack 4 and the plaiting arm 3. In addition, the device 1 possesses a feed device 11 for covering the auxiliary depositing means 5 with flat, stable underlays 8.

FIG. 1 portrays the initial step of a plaiting cycle. The term "plaiting cycle" is here understood to be the laying in folds of a material stack 4 on the plaiting table 2, with subsequent emptying of said plaiting table 2.

The web-shaped material is laid with the plaiting arm 3 in zigzag shapes on the plaiting table 2, while the plaiting table 2 is lowered. The lowering speed is selected in such a way that the upper level of the plaited material stack 4 remains at a constant height relative to the plaiting arm 3. The auxiliary depositing means are covered with stable, flat underlays by a feed device.

Figure 2:
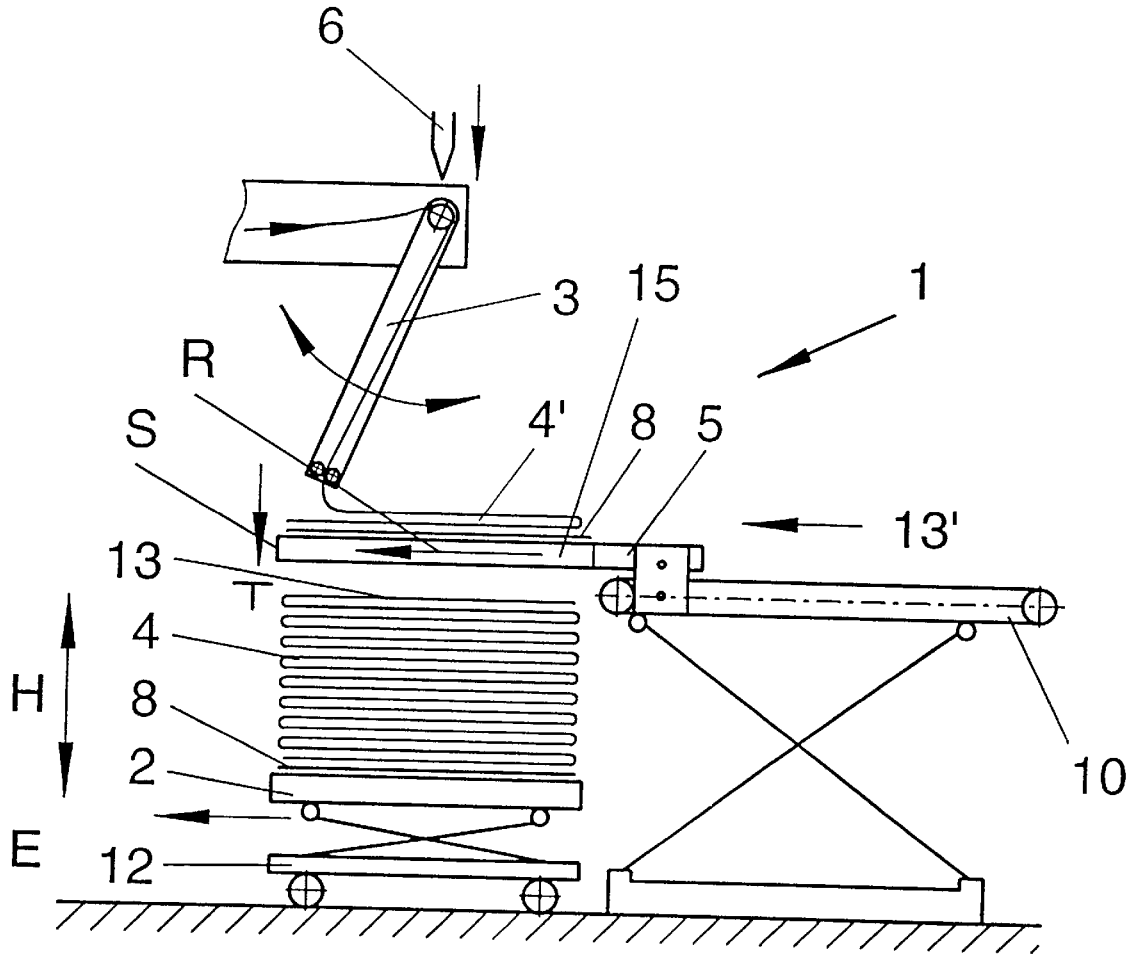

FIG. 2 shows the device according to FIG. 1, shortly after the height H of the stack 4 laid on the plaiting table 2 has reached a desired value. The auxiliary depositing means 5 are inserted horizontally between the material stack 4 and the plaiting arm 3, shortly after the material stack 4 has been separated with a cutting device 6. The subsequent material web is now laid down in a further material stack 4' onto the auxiliary depositing means 5, respectively on the underlay 8 lying upon said auxiliary depositing means. The height-adjustable holder 10, to which the auxiliary depositing means are attached, is lowered in such a way that the upper level 13' of the material stack 4' laid upon the auxiliary means 5 remains at a constant height relative to the plaiting arm 3. The plaiting table 2 with the material stack 4 is moved from a plaiting position T into an unloading position E (see FIG. 3). In order to move from the plaiting position T into the unloading position E, the plaiting table 2 can be mounted on a roller trolley 12. It is also conceivable, however, to mount the plaiting table 2 on rails or on a conveyor belt. After the auxiliary means 5 assumes the function of the plaiting table, the upper level 13 of the material stack 4 can be covered with a flat support 8' of cardboard. The material stack is thus limited on both sides.

Figure 3:
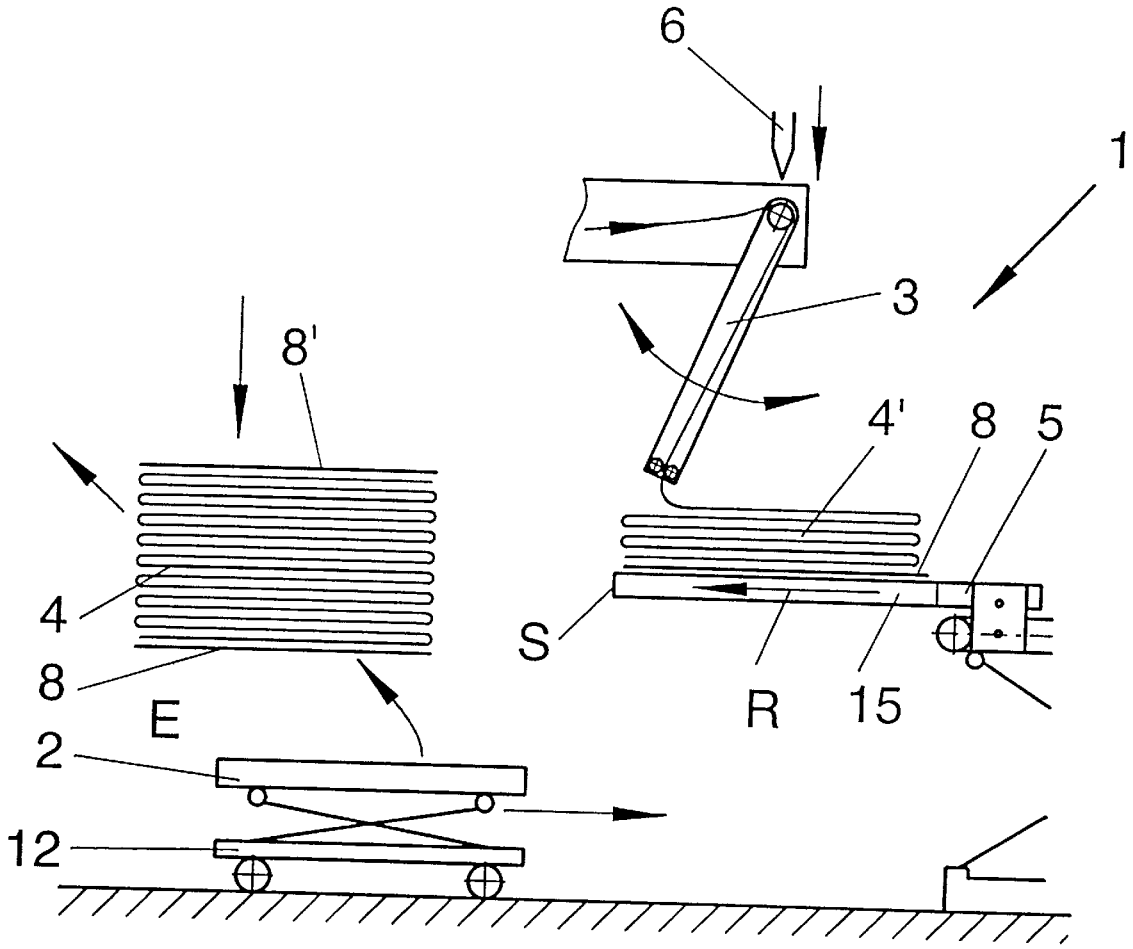

FIG. 3 schematically shows how the material stack 4, together with the underlay 8, is removed from the plaiting table 2 while the next material stack 4' is laid on the auxiliary depositing means 5. The plaiting table 2 is returned to its original position.

Figure 4:
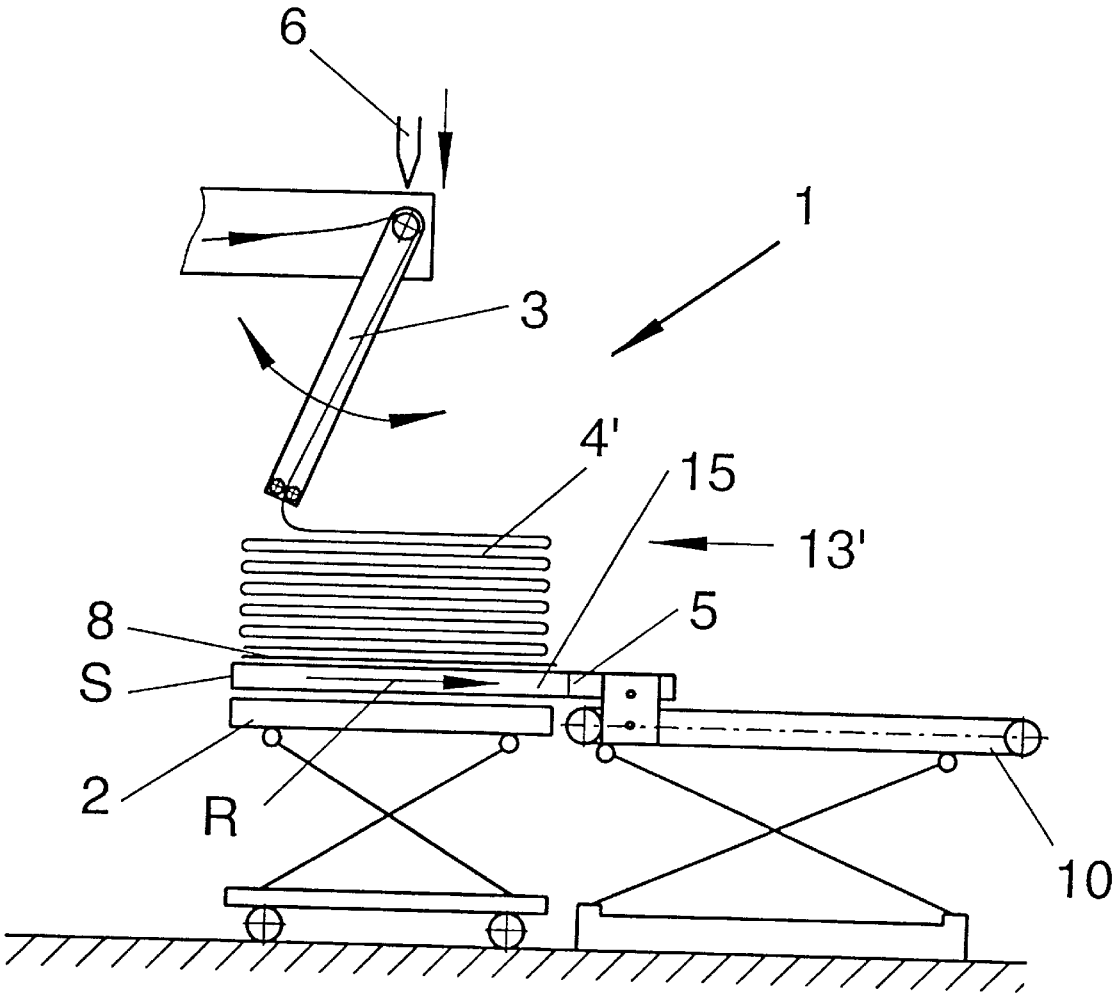

FIG. 4 shows how the plaiting table is positioned directly into the auxiliary depositing means 5. The auxiliary depositing means 5 are pulled out under the underlay 8, by which means the material stack 4' together with the underlay 8 is transferred to the plaiting table 2. The auxiliary depositing means 5 is returned to its original position, and the web-shaped material is plaited onto the plaiting table 2. By means of the height-adjustable holder 10, the auxiliary depositing means 5 is once again brought to a position corresponding to that shown in FIG. 1.

Figure 5:
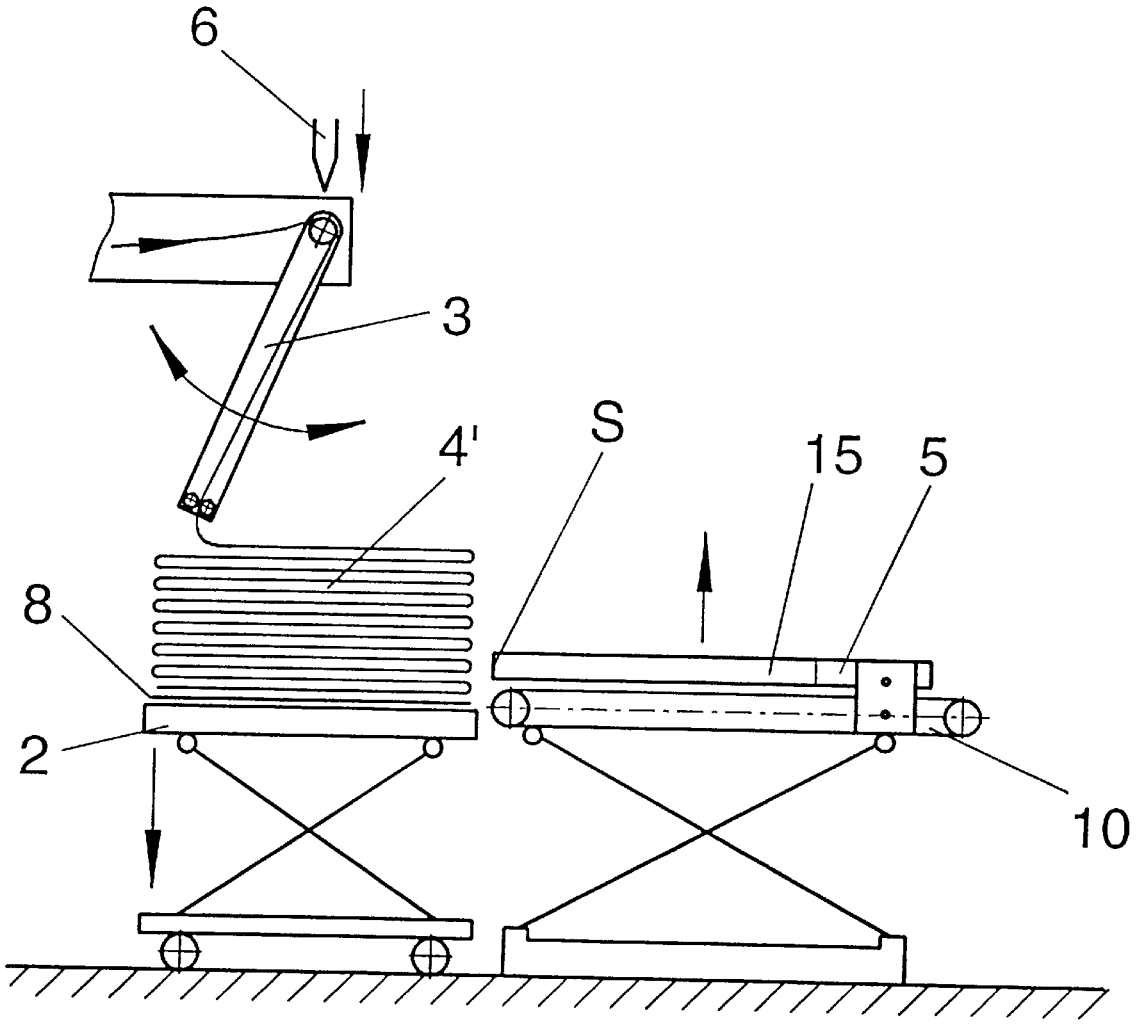

In FIG. 5, the plaiting cycle is complete, and a further cycle according to FIG. 1 can ensue.

Because the auxiliary depositing means 5 assumes the function of the plaiting table during unloading of said plaiting table, uninterrupted plaiting is possible.

Figure 6A:
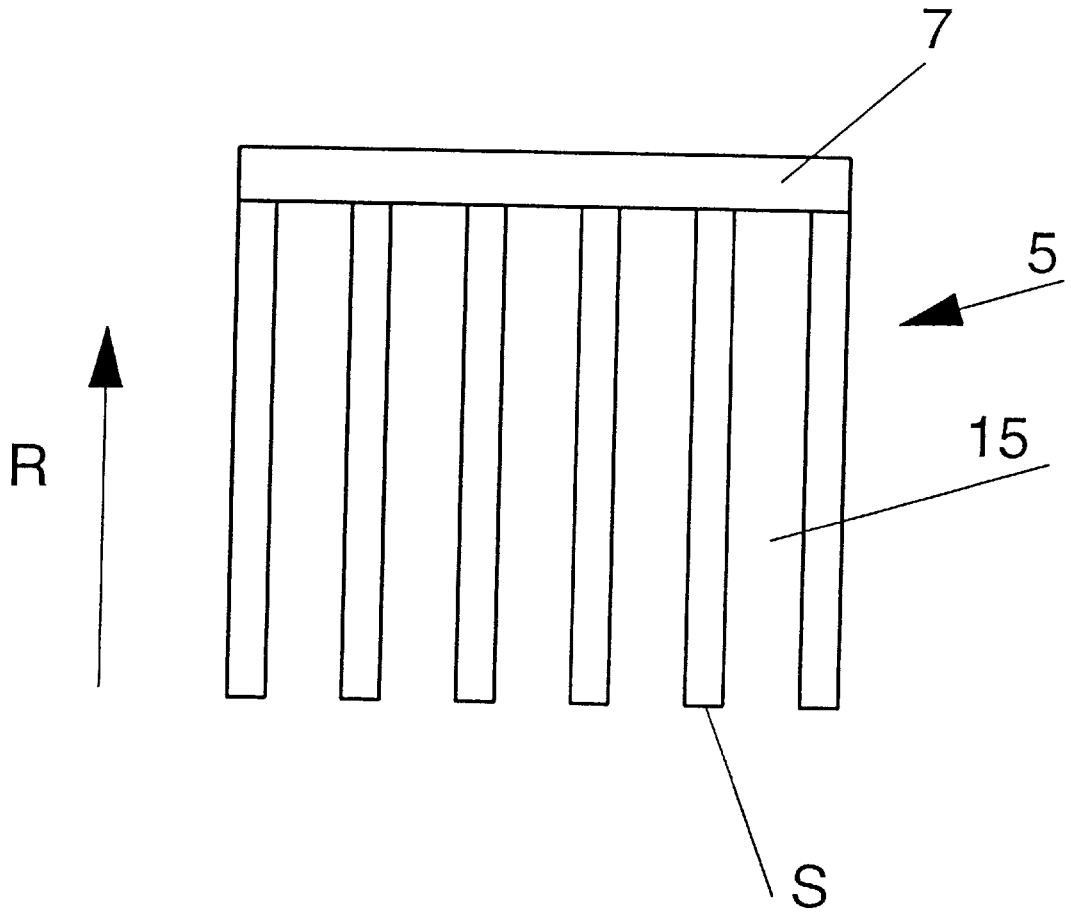

FIG. 6*a* shows a plan view of the auxiliary depositing means 5 according to the present invention, said auxiliary depositing means being formed as a rack 7. Intermediate spaces 15 are present between the individual rods of the rack through which supporting elements 16 (see FIG. 7) of a plaiting table 2 can be inserted from beneath and raised. The recesses 15 extend from the face S of the auxiliary depositing means 5 in the direction of insertion R.

Figure 6B:
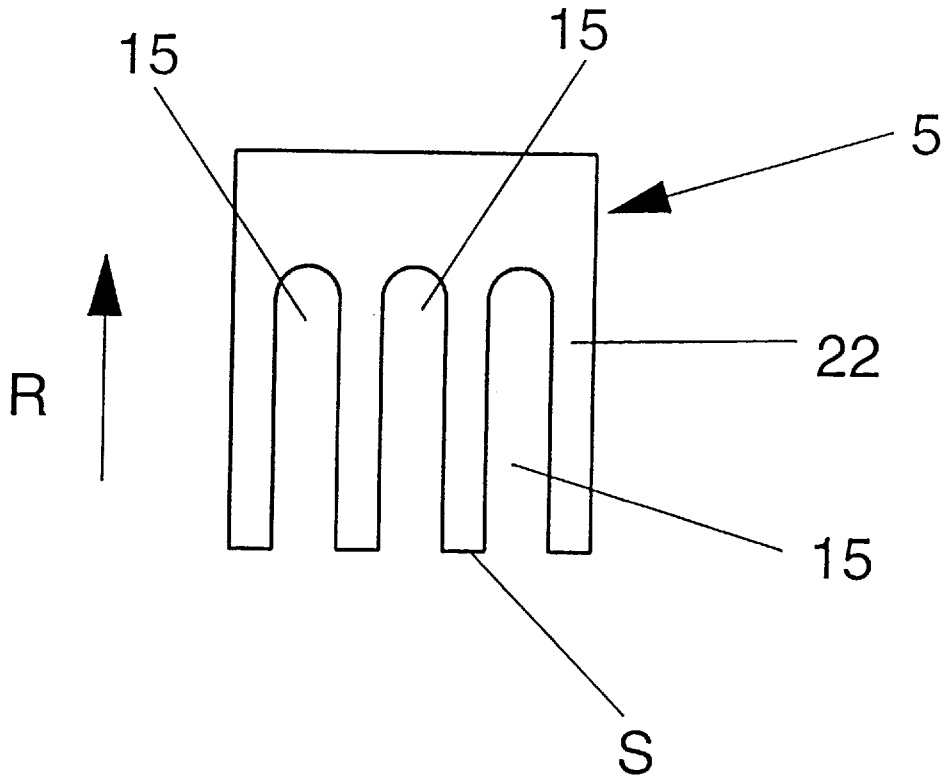

FIG. 6*b* shows a modified embodiment of the auxiliary depositing means according to the present invention. The auxiliary depositing means 5 are formed as a plate 22 possessing recesses 15. The recesses 15 extend from the face S of the plate 22 in the direction of insertion R.

Figure 6C:
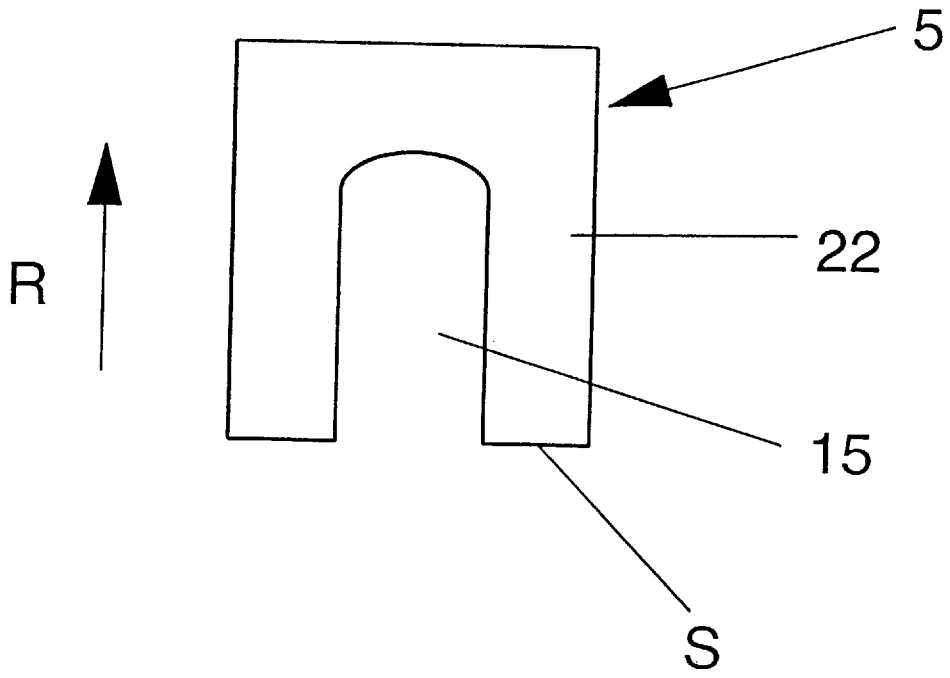

FIG. 6*c* shows a plate 22 with a single recess 15. Basically, any number of recesses is possible. In order to ensure the best possible weight distribution of the material laid onto the auxiliary depositing means 5 as well as a uniform transfer of the material from the auxiliary depositing means to the plaiting table, a greater number of recesses, for example five to ten, is recommended.

Figure 7:
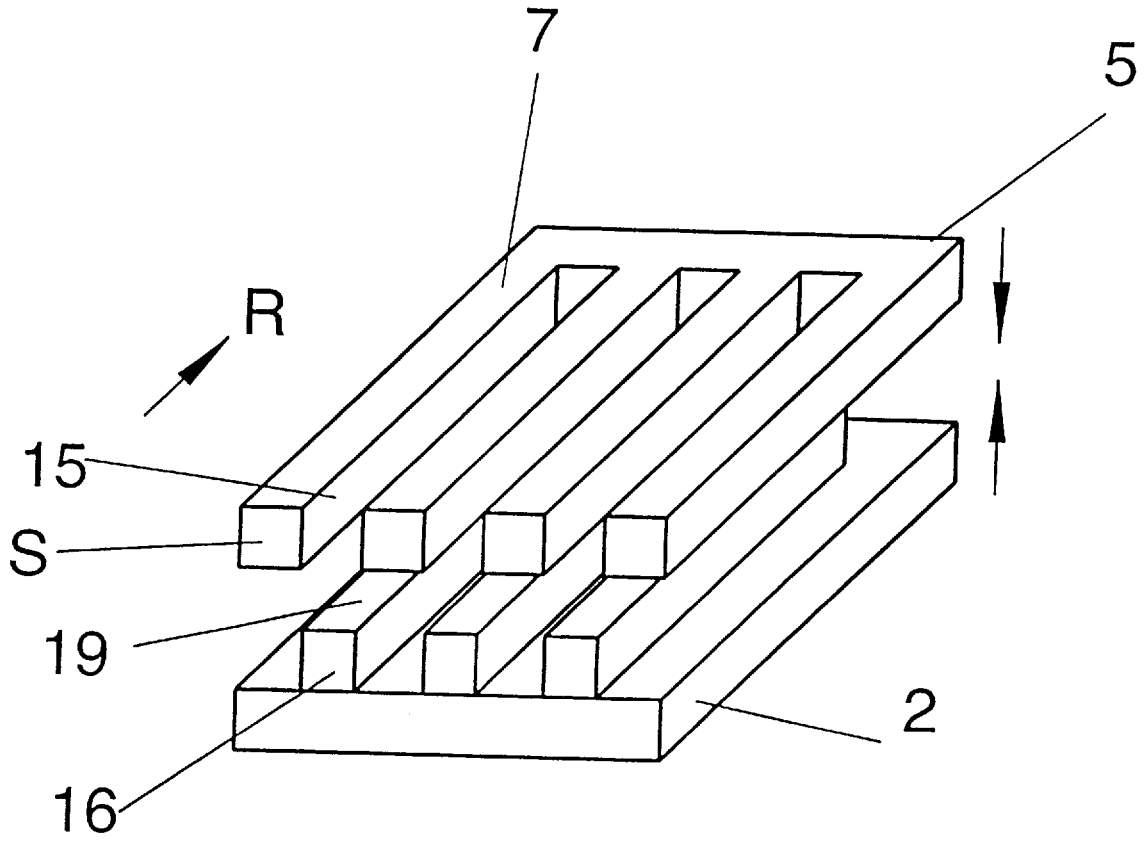

FIG. 7 schematically shows a plaiting table 2 with an auxiliary depositing means 5 according to the present invention in the form of a rack 7. For reasons of clarity, the material stack laid upon the rack 7 is not shown. The rack 7 possesses recesses 15 extending from the face S in the direction of insertion R. The plaiting table 2 possesses supporting elements 16 protruding from its surface. The supporting elements 16 form a support surface 19 for the plaited material. On transfer of the material stack from the auxiliary depositing means 5 to the plaiting table 2, the plaiting table 2 is raised and/or the auxiliary depositing means 5 is lowered, so that the supporting elements 16 of the plaiting table 2 penetrate the intermediate spaces 15 of the auxiliary depositing means 5. The supporting elements 16 raise the material web laid on the auxiliary depositing means 5 so that said material web lies upon the support surface 19. Subsequently, the rack 7 which is now relieved of the material stack can be withdrawn laterally between the supporting elements 16. With particular advantage, this embodiment can be used in combination with an underlay 8. In this case, not the plaited and deposited material stack, but rather the underlay, will be raised by the supporting elements 16.

Figure 8A:
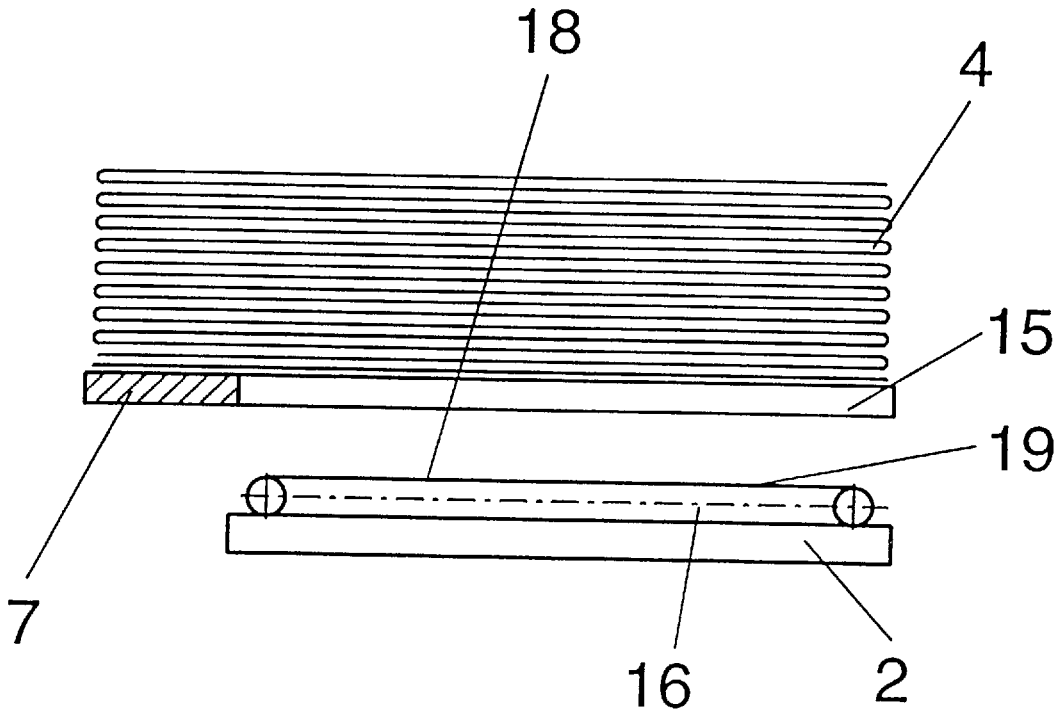
Figure 8B:
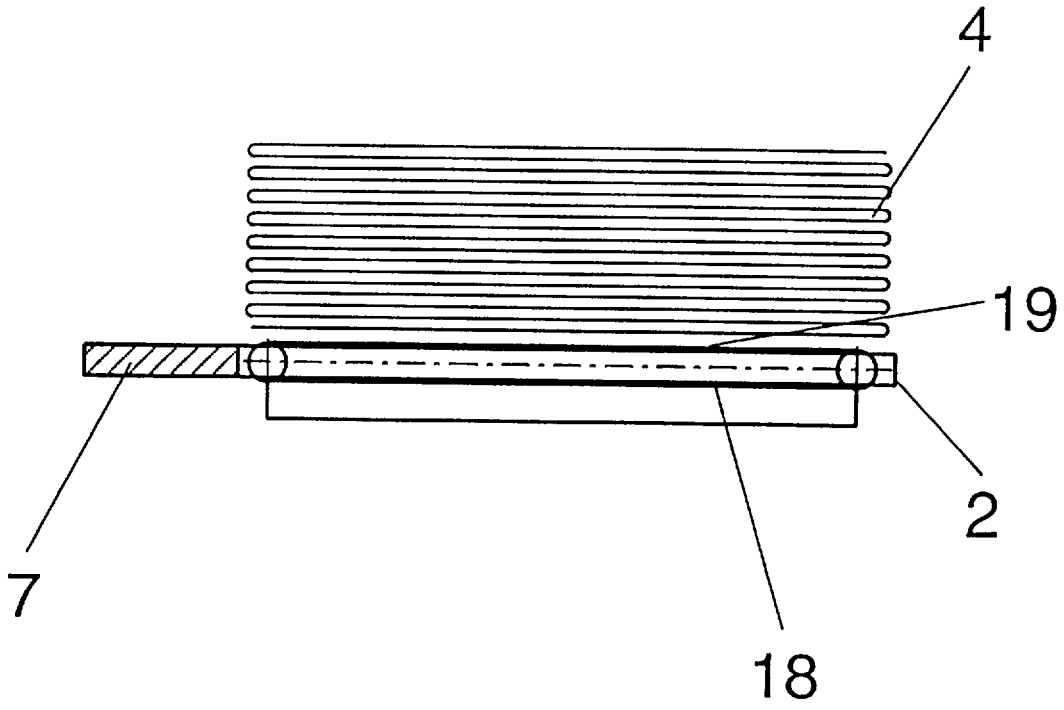
Figure 8C:
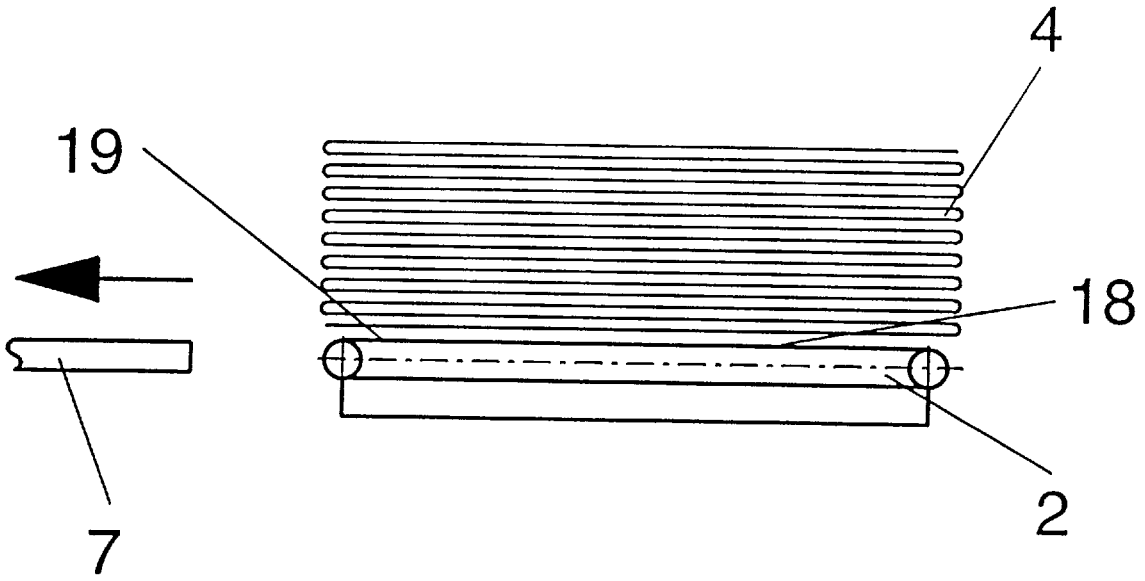

FIGS. 8*a* to 8*c* show a further embodiment, wherein the supporting elements 16 comprise two belts mounted to move on rollers. Similar to FIG. 7, a plaited stack of material 4 is transferred from the rack 7 onto the support surface 19 formed by the supporting elements 16. The support surface 19 is essentially formed by the belt 18. The particular advantage of this arrangement is that the material stack 4 (optionally on an underlay 8 placed upon the auxiliary depositing means 5 prior to the plaiting sequence) is simply removed from the plaiting table 2. It is sufficient to move the band 18 forming the support surface 19 in such a way that the material stack 4 is slid laterally from the plaiting table. It is conceivable, for example, to transfer the material stack 4 from the plaiting table 2 to a packaging station, into storage, or onto a transport means.

Figure 9:
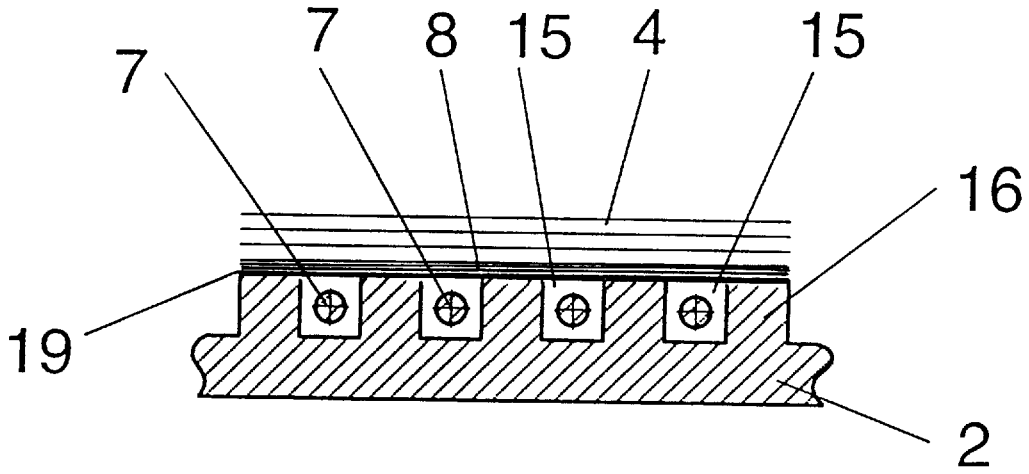

FIG. 9 schematically shows the frontal view of the embodiment according to FIG. 7 during transfer of the material stack 4 from the rack 7 to the plaiting table 2. The supporting elements 16 of the plaiting table 2 are so arranged that they penetrate the recesses 15 between the individual arms of the rack 7. The material stack 4 is raised by the supporting elements 16 and lies on the support surface formed by the supporting elements 16. The rack 7 is thus relieved, and can simply be pulled out between the plaiting table 2 and the plaited and deposited material stack 4 (or optionally the underlay 8). In FIG. 9, such an underlay is likewise schematically shown. The underlay 8 is, however, not absolutely essential for correct functioning of the device or method according to the present invention.

Inasmuch as the invention is subject to modifications and variations, the foregoing description and accompanying drawings should not be regarded as limiting the invention, which is defined by the following claims and various combinations thereof:

I claim:

1. A device for continuously plaiting web-shaped textile material on a support surface (19) of a plaiting table (2) by means of a plaiting arm (3) and unloading the material plait and deposited on the plaiting table (2) comprising:

means for separating a respective stack (4) of material plaited and deposited on the plaiting table (2);

auxiliary deposition means equipped with an insertion face (S) and at least one recess (15) extending from the insertion face (S) and complementary with the support surface (29) of the plaiting table (2);

means for inserting in an insertion direction, the auxiliary depositing means (5), on which the material is laid during unloading of the material plaited and deposited on the plaiting table (2), into a position between the plaiting arm (3) and the plaiting table (2) to separate the material between the plaiting table (2) and the auxiliary means (5) in order to continue plaiting on the auxiliary depositing means (5) while lowering the auxiliary depositing means in such a way that an upper level (13) of the material stack (4) is maintained at a constant level;

means for displacing the plaiting table from a plaiting position (T) into an unloading position (E) and replacing the loaded plaiting table (2) with an empty plaiting table; and means for raising the support surface of the plaiting table (2) when the support surface is positioned beneath the auxiliary depositing means (5) while lowering the auxiliary depositing means (5) in such a way that the support surface (19) of the plaiting table penetrates the at least one complementary recess (15) of the auxiliary depositing means from below and supports the plaited and deposition material so as to allow the auxiliary depositing means (5) to be laterally withdrawn in order to ensure continuous plaiting of the web-shaped textile material.

2. Device according to claim 1, characterized in that the auxiliary depositing means (5) possesses a horizontally slidable rack (7).

3. Device according to claim 1, characterized in that the plaiting table (2) is provided with a device for height adjustment.

4. Device according to claim 3, characterized in that the plaiting table (2) is provided with at least one upwardly-pointing supporting element (16) forming a support surface (19) for the material and shaped to be complementary to the recesses (15) of the auxiliary depositing means (5) in such a way that said supporting element (16) can penetrate the auxiliary depositing means in order to raise the material lying on said auxiliary depositing means (5) and relieve said auxiliary depositing means.

5. Device according to claim 1, characterized in that the device (1) possesses a feed device (11) for covering of the auxiliary depositing means (5) with a flat underlay (8).

6. Device according to claim 1, characterized in that the device (1) possesses means (16, 18) for removing the plaited material from the plaiting table (2).

7. Device according to claim 6, characterized in that the means (16, 18) for removing the material are formed by the supporting elements (16).

8. Device according to claim 7, characterized in that the supporting elements are formed as movable belts (18).

9. A method of continuous plaiting web-shaped textile material on a support surface (19) of a plaiting table (2) by means of a plaiting arm (3) and unloading the material plaited and deposited on the plaiting table (2) comprising the sequential steps of:

(a) separating a respective stack (4) of material plaited and deposited on the plaiting table (2);

(b) inserting an auxiliary support surface of an auxiliary depositing means (5), on which the material is laid during unloading of the material plaited and deposited on the plaiting table (2) into position between the plaiting arm (3) and the plaiting table (2) to separate the material between the plaiting table (2) and the auxiliary depositing means (5) in order to continue plaiting on the auxiliary depositing means (5) while lowering the auxiliary depositing means (5) in such a way that an upper level (13) of the material stack (4) is maintained at a constant level;

(c) and then displacing the plaiting table (2) from a plaiting position into an unloading position to unload the deposited plaiting material and replacing the loaded plaiting table (2) with an empty plaiting table, the support surface of the plaiting table being formed by a plurality of protruding supporting elements (16) and the auxiliary depositing means (5) being provided with complementary recesses (15);

(d) raising the support surface (19) of the plaiting table (2), said support surface being positioned beneath the auxiliary depositing means (5) in such a way that the protruding supporting elements (16) penetrate the complementary recesses (15) from below and raise the plaited and deposited material;

(e) relieving the auxiliary depositing means (5) of the plaited and deposited material by laterally withdrawing the auxiliary support surface and complementary recesses (15) of the auxiliary depositing means (5) from the plurality of supporting elements of the plaiting table (2) so as to ensure continuous plaiting of the web-shaped textile material.

10. Method according to claim 9, characterized in that, during the continuous plaiting of the web-shaped material to form a stack (4), the plaiting table is lowered in such a way that the upper level (13) of the material stack (4) is maintained at a constant height in relation to the plaiting arm (3).

11. Method according to claim 9, characterized in that, prior to insertion between the upper level (13) of the stack (4) and the plaiting arm (3), the auxiliary surface (5) is covered with a flat underlay (8), said underlay (8) remaining between the material stack (4; 4') and the plaiting table on removal of the auxiliary depositing means (5).

12. Method according to claim 11, characterized in that the auxiliary depositing means is covered with an underlay (8) of cardboard.

13. Method according to claim 12, characterized in that after insertion of the auxiliary depositing means (5) the upper level (13) of the stack (4) is covered with a flat cover (8') of cardboard.

14. A method of continuously plaiting web-shaped textile material on a support surface (19) of a plaiting table (2) by means of a plaiting arm (3) and unloading the material plaited and deposited on the plaiting table (2) comprising the sequential steps of:

(a) separating a respective stack (4) of material plaited and deposited on the plaiting table (2);

(b) inserting an auxiliary support surface of an auxiliary depositing means (5), on which the material is laid during unloading of the material plaited and deposited on the plaiting table (2), into position between the plaiting arm (3) and the plaiting table (2) to separate the material between the plaiting table (2) and the auxiliary depositing means (5) in order to continue plaiting on the auxiliary depositing means (5) while lowering the auxiliary depositing means (5) in such a way that an upper level (13) of the material stack (4) is maintained at a constant level;

(c) and then displacing the plaiting table (2) from a plaiting position into an unloading position to unload the deposited plaiting material and replacing the loaded plaiting table (2) with an empty plaiting table, the support surface of the plaiting table being formed by a plurality of protruding supporting elements (16) and the auxiliary depositing means (5) being provided with complementary recesses (15);

(d) positioning the support surface (19) of the plaiting table (2) beneath the auxiliary depositing means (5) and then lowering the auxiliary depositing means in such a way that the protruding supporting elements (16) penetrate the complementary recesses (15) from below and raise the plaited and deposited material;

(e) relieving the auxiliary depositing means (5) of the plaited and deposited material by laterally withdrawing the auxiliary support surface and complementary recesses (15) of the auxiliary depositing means (5) from the plurality of supporting elements of the plaiting table (2) so as to ensure continuous plaiting of the web-shaped textile material.

15. A device for continuously plaiting web-shaped textile material on a support surface (19) of a plaiting table (2) by means of a plaiting arm (3) and unloading the material plaited and deposited on the plaiting table (2) comprising:

means for separating a respective stack (4) of material plaited and deposited on the plaiting table (2);

auxiliary deposition means equipped with an insertion face (S) and at least one recess (15) extending from the insertion face (S) and complementary with the support surface (29) of the plaiting table (2);

means for inserting, in an insertion direction, the auxiliary depositing means (5), on which the material is laid during unloading of the material plaited and deposited on the plaiting table (2), into a position between the plaiting arm (3) and the plaiting table (2) to separate the material between the plaiting table (2) and the auxiliary means (5) in order to continue plaiting on the auxiliary depositing means (5) while lowering the auxiliary depositing means in such a way that an upper level (13) of the material stack (4) is maintained at a constant level;

means for displacing the plaiting table from a plaiting position (T) into an unloading position (E) and replacing the loaded plaiting table (2) with an empty plaiting table; and means for lowering the auxiliary depositing means (5) when the support surface of the plaiting table (2) is positioned beneath the auxiliary depositing means (5) in such a way that the support surface (19) of the plaiting table penetrates the at least one complementary recess (15) of the auxiliary depositing means from below and supports the plaited and deposition material so as to allow the auxiliary depositing means (5) to be laterally withdrawn in order to ensure continuous plaiting of the web-shaped textile material.

* * * * *